US005763857A

United States Patent [19]

Klement et al.

[11] Patent Number: 5,763,857

[45] Date of Patent: Jun. 9, 1998

[54] HEATING HOME APPLIANCE

[75] Inventors: Johann Klement, Traunwalchen; Klaus Rabenstein, Traunreut; Klemens Roch, Trostberg, all of Germany

[73] Assignee: Bosch-Siemens Hausgeraete GmbH, Munich, Germany

[21] Appl. No.: 495,801

[22] Filed: Jun. 27, 1995

[30] Foreign Application Priority Data

Jun. 27, 1994 [DE] Germany ..... 44 22 360.9

[51] Int. Cl.[6] ..... F24C 15/34

[52] U.S. Cl. ..... 219/407; 219/405

[58] Field of Search ..... 219/405, 407, 219/408, 391, 406, 424; 52/783.16, 788.1; 126/273.5; 156/272.8, 304.1, 304.6; 220/441, 442, 443

[56] References Cited

U.S. PATENT DOCUMENTS

| | | | |
|---|---|---|---|
| 2,406,815 | 9/1946 | Elfving | 52/783.16 |
| 3,037,592 | 6/1962 | Shipley et al. | 52/783.16 |
| 4,168,013 | 9/1979 | King et al. | 220/442 |
| 4,579,756 | 4/1986 | Edgel | 52/788.1 |
| 5,107,649 | 4/1992 | Benson et al. | 52/788.1 |

FOREIGN PATENT DOCUMENTS

| | | |
|---|---|---|
| 270984 | 6/1988 | European Pat. Off. . |
| 2549834 | 8/1978 | Germany . |
| 1-150098 | 6/1989 | Japan . |

*Primary Examiner*—Teresa J. Walberg
*Assistant Examiner*—J. Pelham
*Attorney, Agent, or Firm*—Herbert L. Lerner; Laurence A. Greenberg

[57] ABSTRACT

A heating home appliance, in particular a household appliance such as an oven, includes an appliance space having at least one heating body. At least one multi-ply layer of air-tight foils at least partly surrounds the appliance space, enclosing air chambers, being at least peripherally joined together and otherwise being kept mutually spaced apart from one another. The at least one foil layer has foil edges, with an air-tight-sealed edge on all sides being formed of the foil edges and forming a flexible fastening and/or connecting element.

26 Claims, 4 Drawing Sheets

HEATING HOME APPLIANCE

BACKGROUND OF THE INVENTION

1. Field of the Invention

The invention relates to a heating home appliance, in particular a household appliance such as an oven, having an appliance space with at least one heating body, being at least partly surrounded by at least one multi-ply layer of airtight foils that enclose air chambers and are joined together at least peripherally and otherwise are kept mutually spaced apart from one another.

In order to provide thermal insulation of baking ovens, fiber insulating materials, such as ceramic fiber mats, are currently exclusively used. They surround the oven box, including any heating elements located on the outside. Fiber insulating materials of that kind are increasingly considered a threat to health. In the place of fiber insulating material, in a proposal known from German Patent DE-PS 25 49 834, an insulating foil, for instance of aluminum, is wound in one or more layers around wall surfaces of the oven box, creating air chambers, through the use of peripheral spacer strips, disposed between the wall surfaces of the oven box and the insulating foil, or between the individual layers of the insulating foil. The spacer strips in that case must again be formed of a material which withstands the relatively high temperatures that occur in normal roasting and baking, or in an extreme case when pyrolytic self cleaning is performed in the interior of the oven box, as well as temperatures that also appear and are correspondingly reduced, on the outside of the oven box. The aforementioned proposal recommends using asbestos foam for that purpose, but while that material is heat-resistant, it is not without its problems.

SUMMARY OF THE INVENTION

It is accordingly an object of the invention to provide a heating home appliance, in particular a cooking appliance such as a baking oven, which overcomes the hereinaforementioned disadvantages of the heretofore-known devices of this general type, in which health problems no longer arise in terms of its thermal insulation and in which the insulation is not only highly processable and takes up little space but has a maximum thermal insulating capacity that is even partially variable.

With the foregoing and other objects in view there is provided, in accordance with the invention, a heating home appliance, in particular a household appliance such as an oven, comprising an appliance space having at least one heating body; at least one multi-ply layer of air-tight foils at least partly surrounding the appliance space, enclosing air chambers, being at least peripherally joined together and otherwise being kept mutually spaced apart from one another; the at least one foil layer having foil edges, having an air-tight-sealed edge on all sides being formed of the foil edges and forming an element for at least one of flexible fastening and connecting.

In accordance with another feature of the invention, the at least one foil layer is formed of a homogeneous material, preferably aluminum foil material.

In accordance with a further feature of the invention, the at least one foil layer is a plurality of foil layers being air-tightly insulated from one another and at least partly surrounding the appliance space.

In accordance with an added feature of the invention, the foil layers have different numbers of the foils.

In accordance with an additional feature of the invention, the foil layers are components of a common foil layer strip being interrupted in terms of air from one another by sealed peripheral sections.

In accordance with yet another feature of the invention, the at least one foil layer includes immediately adjacent foil layers overlapping at boundary regions.

In accordance with yet a further feature of the invention, the plurality of foil layers includes adjacent foil layers abutting one another directly at an abutting point, and having edges being bent away from the abutting point.

Experiments have shown that when the air chambers enclosed in the foil layer are at least largely sealed off in air-tight fashion, a targeted, increased insulating action is attainable, because an exchange of the heated air in the air chambers can be partly limited or prevented over relatively large areas. Since securing and/or connecting elements are formed by the edges or peripheral sections of the foils themselves, a very small material cross section is attained at these points, along with excellent manipulability and adaptability of these securing and/or connecting elements, which, for instance, are peripheral, to the particular placement of the foil layer or layers in the surroundings of the space that is defined, for instance, by an oven door or some other housing. The structure of these fastening and/or connecting elements offers the opportunity, for instance, of putting a plurality of foil layers tightly together and, for instance, bending the compacted and flexible edges accordingly, or of using closed-off peripheral segments of a larger sheet of foil film as corner connectors between foil layers that are angled relative to one another. Through the use of suitable surface profiling of the cover layers of the foil layers or edges or peripheral segments, thermal conduction from the housing or oven box to the foil layer, or between the fastening and/or connecting elements, can be reduced purposefully, so that only pointwise contact between the aforementioned parts takes place, for instance. An advantage of the invention, which is not the least advantage, is that the products according to the invention can be made 100% material-free and recyclable.

In accordance with yet an added feature of the invention, the individual foils of the at least one foil layer have foil embossed locations forming small-area spacer elements keeping the foils spaced apart from one another.

In accordance with yet an additional feature of the invention, the at least one foil layer includes at least two outer cover foils and at least one foil being disposed between the outer cover foils and having the embossed locations forming the spacer elements.

In accordance with again another feature of the invention, the at least one foil disposed between the outer cover foils is at least two foils having the embossed locations being randomly shaped and crosswise to one another.

In accordance with again a further feature of the invention, the at least one foil disposed between the outer cover foils is a plurality of inner foils having substantially cup-shaped spacer elements being directed toward one another.

Therefore, according to a preferred embodiment, the spacer elements for forming the air chambers are formed by the foils themselves, if these foils, for instance, have cup or bowl-shaped embossed locations that support one another mutually over a small surface area. A certain contact between the foils may also be desired even inside the outer edges or peripheral sections, in order to enable purposeful dissipation of thermal energy from thermally extremely highly stressed points, such as the oven box, to places that are less highly stressed. It can also be desirable to use the peripheral fastening and/or connecting elements, for instance, to perform a so-called heat dissipation from the front region of the device or from the region of the front flange of the box.

In accordance with again an added feature of the invention, the spacer elements support one another in honeycomb-like fashion. Therefore, a preferred provision for retaining and positioning the individual foils which are spaced apart from one another is accomplished by profiling the inner foils, for instance, in such a way that the foil layer is honeycomb-like in cross section. The embossed points which are supported on one another may bring about a mutual fixation of the individual foils in the composite, so that differing thermal expansions or mechanical strains, for instance, can be accommodated.

In accordance with again an additional feature of the invention, the at least one foil layer is disposed in a given plane, the spacer elements have support surfaces being parallel to the given plane, the support surfaces have preferably circular foil indentations formed therein, and the at least one foil layer includes at least one adjacent foil having small-area support surfaces being form-lockingly retained in the indentations.

In accordance with still another feature of the invention, at least one of the cover foils has protuberances and indentations formed therein by profiling a surface.

In accordance with still a further feature of the invention, at least one of the edges and the peripheral sections of the foils are interlocked with one another at deep-drawn and preferably crimped locations engaging one another from behind.

In accordance with still an added feature of the invention, the edges or peripheral sections have a plurality of interlocking locations preferably overlapping one another.

In accordance with still an additional feature of the invention, the edges or peripheral sections of the foils are welded together.

In accordance with another feature of the invention, at least one of the cover foils is formed of a high-heat-resistant material, such as sheet steel or special sheet steel.

In accordance with a further feature of the invention, there is provided housing forming the appliance space and having regions being under heavy thermal strain or needing to be thermally relieved, the edges or peripheral sections of the at least one foil layer being thermally closely coupled to the regions of the housing.

In accordance with a concomitant feature of the invention, the housing has a loading flange being peripherally coupled.

Other features which are considered as characteristic for the invention are set forth in the appended claims.

Although the invention is illustrated and described herein as embodied in a heating home appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
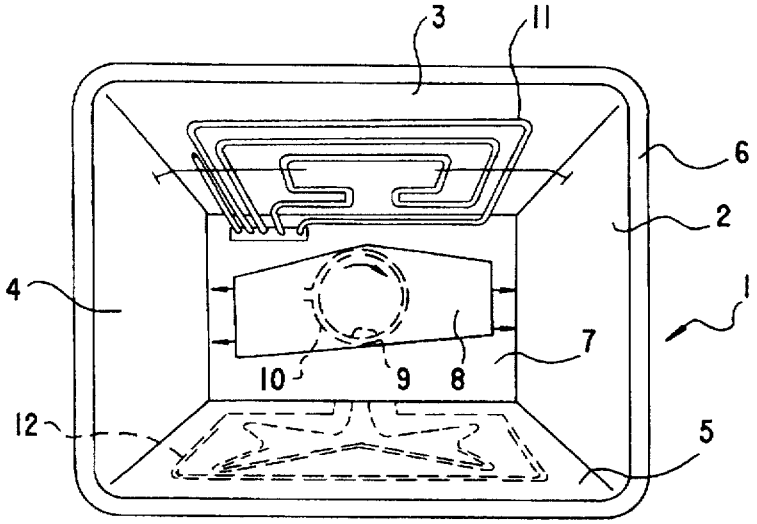
FIG. 1 is a diagrammatic, perspective view of a heating home appliance in the form of an oven box.

Referring now to the figures of the drawing in detail and first, particularly, to FIG. 1 thereof, there is seen a front perspective view of a housing of a heating home appliance in the form of a block-shaped baking oven box 1, which has four oven walls 2, 3, 4 and 5 disposed at right angles to one another, and an oven flange or oven loading flange 6 at the front being bent at angles and extending all the way around a front opening of the oven box. An air distribution shaft 8 is disposed in front of a rear oven wall 7 and has a corresponding blower 9 and air heater 10. In this way, heated streams of air can be blown in the direction of arrows into an appliance space in the interior of the oven box 1. A radiant heating body 11 is located on the inside of the upper oven wall 3, while a heating body 12 is located on the outside, below the lower oven wall 5, and acts as a so-called bottom heater.

Figure 2:
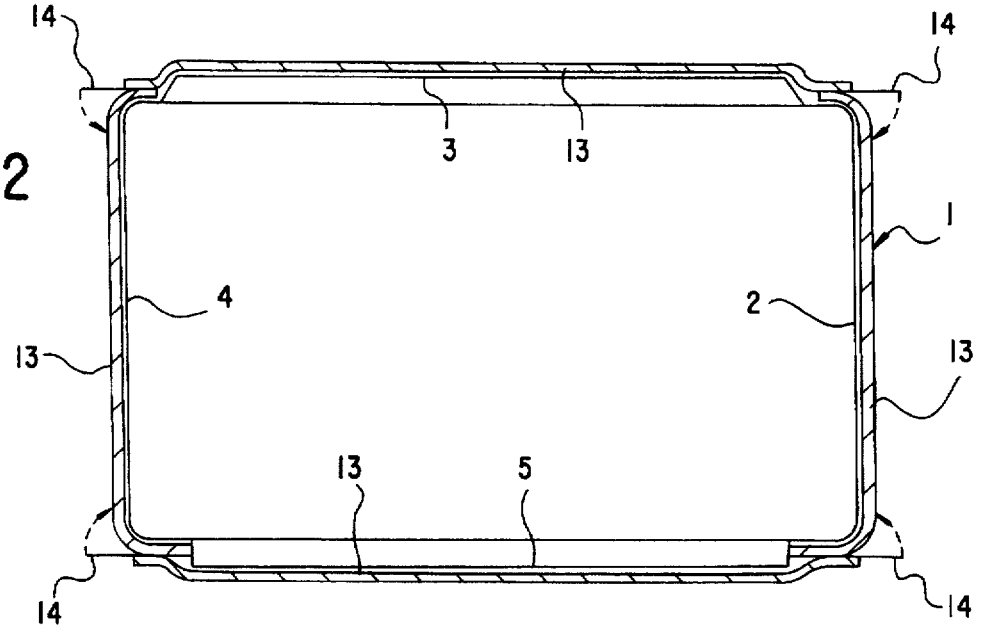
FIGS. 2 and 3 are longitudinal-sectional views of two different variant ways of lining an oven box with foil layers.

In the exemplary embodiment of FIG. 2, reference numeral 1 again designates an oven box, but it is somewhat altered in cross section and the loading flange 6 of FIG. 1 is not shown. In this example, the oven walls 2, 3, 4 and 5 are surrounded in a dimensionally adapted fashion by four foil layers 13, having a structure which will be described in further detail below. Each foil layer 13 has flexible edges 14 on the periphery, that are formed of the foils themselves and act as fastening and/or connecting elements, which protrude beyond the outer dimensions of the oven box 1. Once the respective foil layer 13 has been applied and dimensionally adapted to the outside of the oven box 1, the flexible edges 14 are folded over in the direction of an arrow onto the adjacent foil layer. Due to the mutual overlapping of the foil layers 13, a gap-free thermal insulation of the applicable oven walls is obtained.

Figure 3:
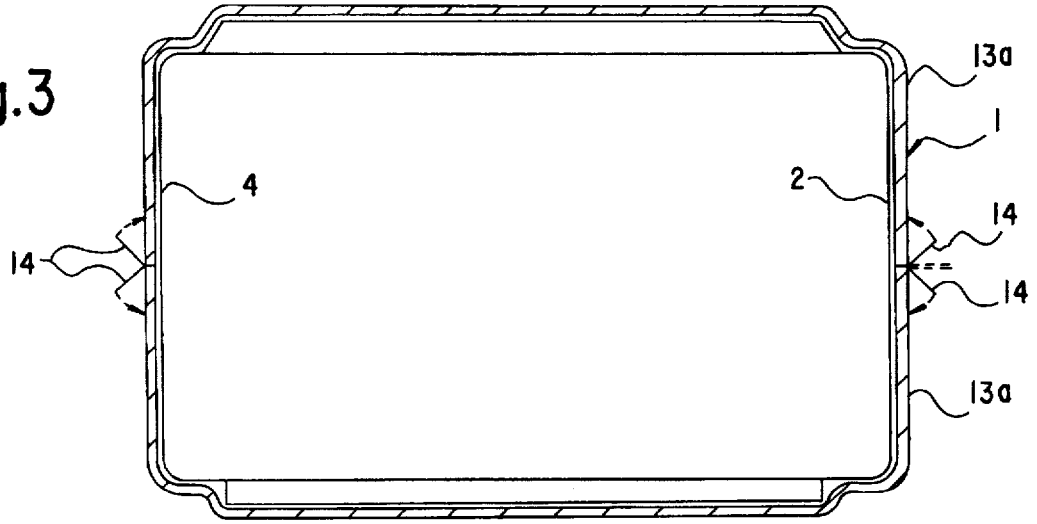

In the exemplary embodiment of FIG. 3, only two longer foil layers **13*a* are provided in order to insulate the oven walls of the oven box 1. The longer foil layers 13*a* form a butt joint with one another in a middle region of the lateral oven walls 2 and 4, and their edges 14 are bent outward and folded back in the direction of an arrow onto the respective foil layer 13*a***, or else they protrude and are folded together outward, as is indicated in dashed lines.

Figure 4:
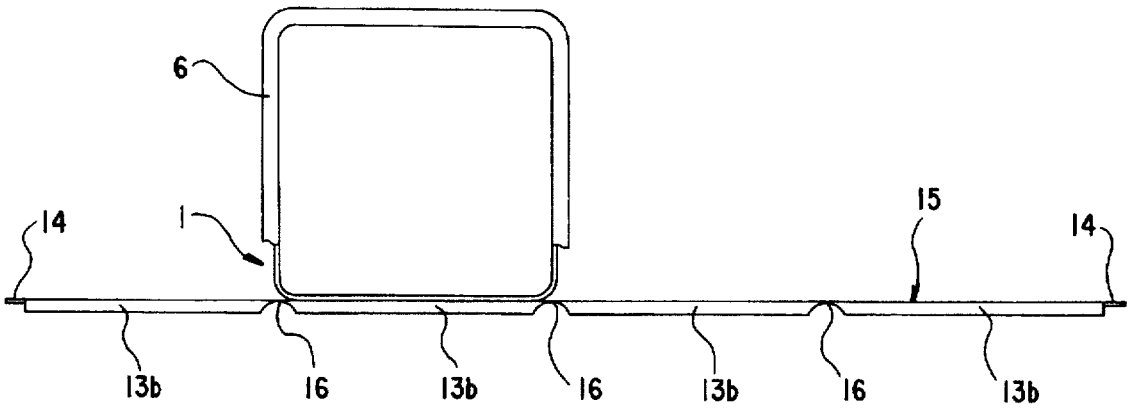
FIG. 4 is an elevational view of an oven box with an unwound insulation formed from a plurality of cohering foil layers.

In the exemplary embodiment of FIG. 4, a front view of an oven box 1 is again shown diagrammatically, with the loading flange 6 broken away. A one-piece foil layer strip 15 is used to insulate the aforementioned oven walls. The foil layer strip 15 has four foil layers **13*b* being separated from one another by compressed peripheral segments 16 and it also has edges 14 that protrude into the open on both ends. This foil layer strip 15 is wound around the aforementioned oven walls, and the compressed peripheral segments 16 act as bent connecting elements in the corner regions of the oven box 1**.

Figure 5:
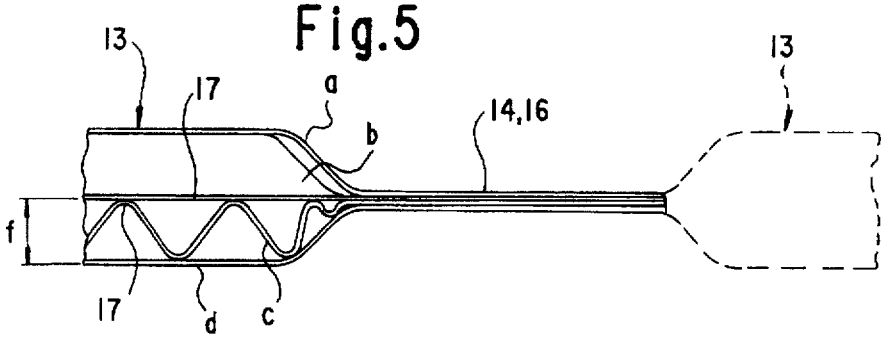
FIGS. 5–7 respectively show simplified, fragmentary, elevational views of a peripheral region of one and two foil layers, and a structure of an edge or peripheral section.
Figure 6:
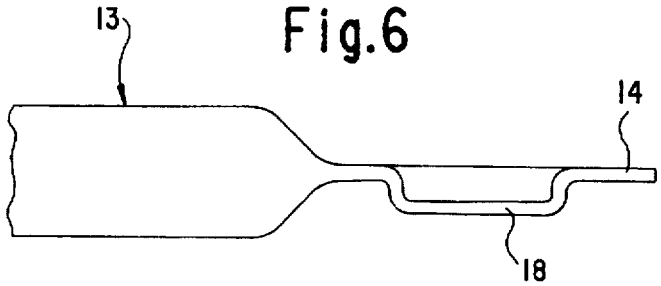
Figure 7:
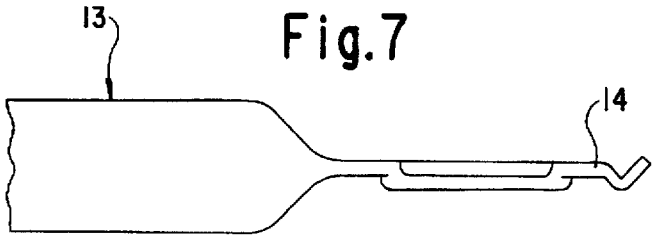
Figure 8:
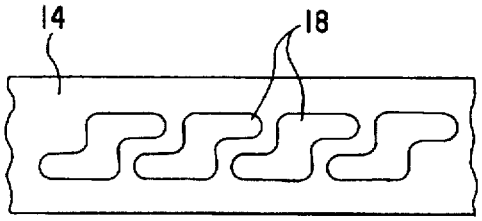
FIG. 8 is a fragmentary, plan view of an edge or peripheral section of a foil layer.

FIG. 5 shows a part of a foil layer 13 on a larger scale with an associated edge 14 or peripheral section 16, in an embodiment of a foil layer strip. This foil layer 13 is multi-ply or multilayered and includes, for instance, four aluminum foils a, b, c and d. The foils a and d are outer cover foils. The foils b and c are inner foils in the exemplary embodiment, they have a random embossed pattern, for example, and they are disposed crosswise to one another. In other words, randomly patterned and elongated embossed locations 17 are perpendicular to one another and touch at isolated points. These embossed locations 17 act as spacer elements, which keep the multi-ply or multilayered foils a, b, c and d of this example spaced apart from one another by a predetermined amount. In the region of their edges, the foils are placed directly one on the other and are sealed at least approximately air-tightly by compression. This compression can be performed by repeated partial deep drawing of the foil composite in the region of deep drawing locations 18 as is shown in FIGS. 6 and 7, although not all of the foils are shown. Subsequent crimping of the deep drawing locations 18 produces a flat edge 14, having foil edges which are interlocked undetachably with one another, as FIG. 7 shows. The deep drawn and crimped points may have an approximately Z-shaped profile overlapping one another, as is shown in the plan view of FIG. 8.

Figure 9:
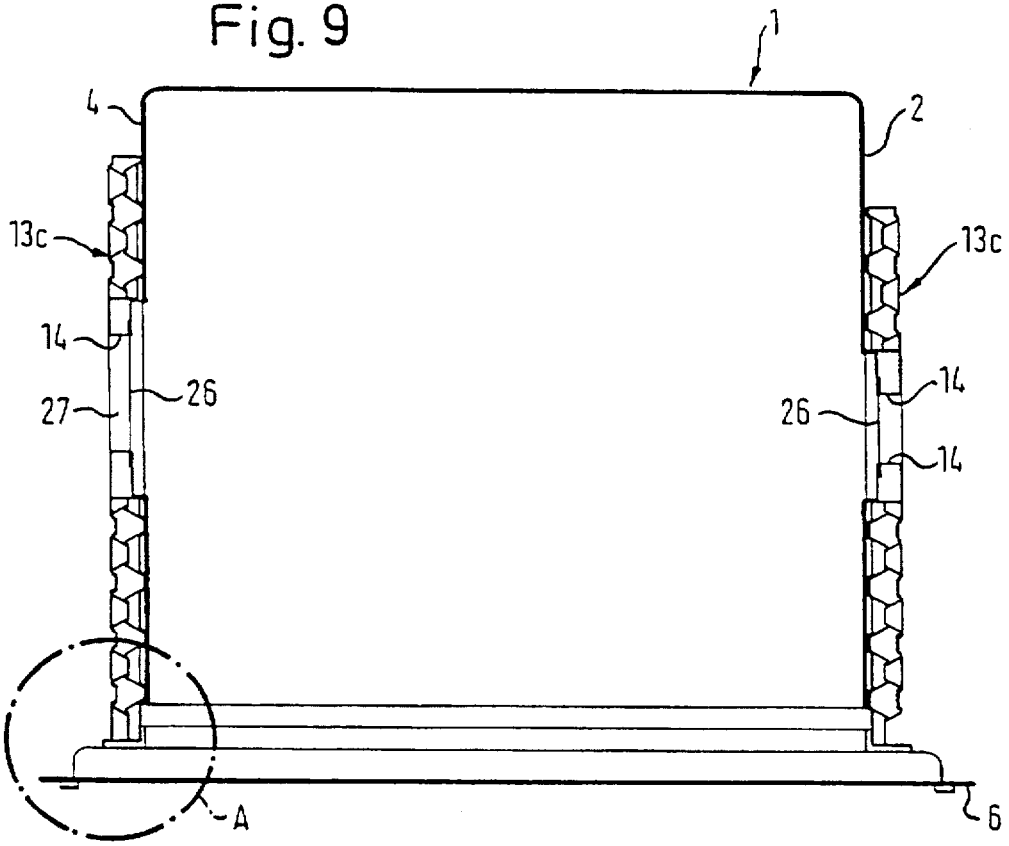
FIG. 9 is an enlarged, longitudinal-sectional view of an oven box with an insulation enveloping it and being formed as a foil layer.

FIG. 9 shows the oven box 1 in a horizontal section in somewhat more detail. This box has the loading flange 6 on the front. It can be seen that the outer surfaces of the lateral oven walls 2 and 4 have foil layers **13*c*, which may, for example, be part of a one-piece foil layer strip. The foil layer 13*c* which is used in this case is shown in further detail in FIGS. 10 and 11 and it includes two outer cover foils a' and d' and two inner foils b' and c'. The inner foils b' and c' are provided with cup-shaped or depression-shaped spacer elements 19*a* and 19*b* which are constructed in a regular pattern as embossed locations and support one another mutually. These multi-ply or multilayered profiled foils b' and c' are disposed and associated with one another in such a way, or laid on one another in such a way, that the spacer elements 19*a* of the foil c', for instance, meet the spacer elements 19*b* of the foil b' in such a way that they support one another. These foils are constructed identically. The spacer elements 19*a* have preferably circular indentations 20 at supporting surfaces, in which the contrasting spacer elements 19*b* dip with their flat supporting surfaces and are retained in form-locking fashion. A form-locking connection is one which connects two elements together due to the shape of the elements themselves, as opposed to a force-locking connection, which locks the elements together by force external to the elements. In this way a solid fixation of the foil composite is attained, so that even if the foil layer 13*c* bends, the predetermined honeycomb-like pattern is preserved. A further factor is that the cover foils a' and d' are similarly provided with profiling and specifically with protuberances 21 on one, and indentations 22, in the other. The flat surrounding surfaces of the spacer elements 19*b* engage the protuberances 21** and are fixed there.

Figure 11:
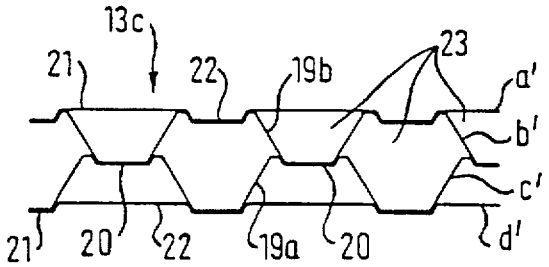
FIGS. 11, 12 and 13 are cross-sectional views of three variants of an insulating layer.
Figure 12:
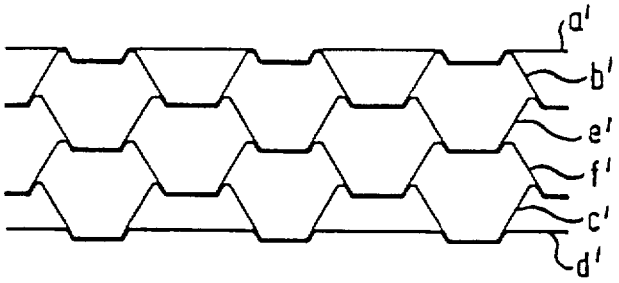

In the exemplary embodiment of FIG. 12, the honeycomb-like foil layer pattern is further extended by two additional foils e' and f', having a structure and configuration that is analogous to the foil layer **13*c* shown in FIG. 11. Through the use of the cup or bowl-shaped spacer elements 19*a* and 19*b*, a number of air chambers 23 are formed between the cover foils a' and d'. These chambers 23 are sealed at the periphery in the above-described manner, for instance by the edges 14 or peripheral sections 16**.

Figure 10:
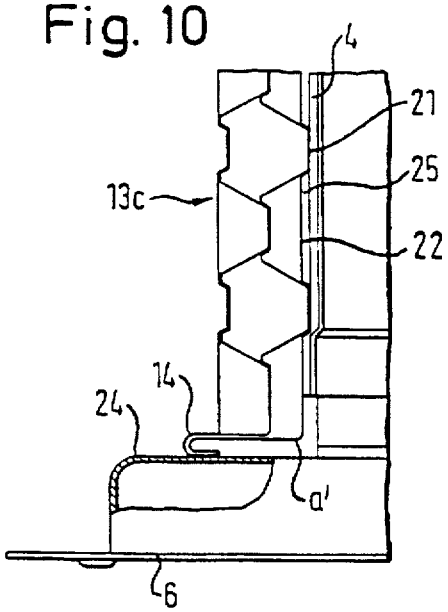
FIG. 10 is a further enlarged, longitudinal-sectional view of a portion A of the oven box of FIG. 9.

In the exemplary embodiment of FIGS. 9 and 10, the edge 14 that defines the foil layer **13*c* on one side is bent at an angle of 180° and is thermally closely and directly coupled to an inner surface 24 of the loading flange 6, or secured to it over a relatively large area. In particular, whenever the cover foil, such as the cover foil a' directly contacting the oven box 1, is formed of a high-heat-resistant material such as sheet steel of a somewhat larger cross section, the result attained in this way is an intensive outflow of the heat produced in the region of the loading flange 6, when the oven is operated at operating temperatures of approximately 500° C., particularly in the pyrolytic self-cleaning mode, and thus a lowering of the flange temperature is attained. Moreover, a certain control of the heat distribution and a direct coupling of the inner cover foil a' to the oven box 1 over a small surface area, for instance a coupling to the oven wall 4, is attained because only the protuberances 21 of the foil layer 13*c* or of the cover foil a' are in direct contact with the box wall 4, while air chambers are formed between these protuberances 21 in the region of the indentations 22**.

As is shown in FIG. 9, provision may be made so that in the lateral oven wall 2 or 4, for instance, there is a recess with a cutout 26, for instance for receiving an oven lighting device. In a similar way to the situation with the loading flange 6, the edge 14 of the foil layer **13*c* can be bent in this case as well and secured directly to the outer wall of the cutout 26 for purposes of heat dissipation. The foil layer 13*c* is therefore provided with a circular or elongated recess 27, for instance, which is bounded by the encompassing edge 14**.

Figure 13:
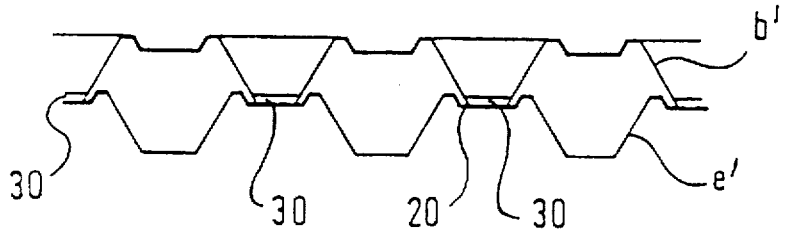

FIG. 13 shows essentially the same structure as FIG. 11 or FIG. 12. In this case, between the contacting or supporting points, or in other words the indentations 20 of the profiled foil e' and the flat supporting surfaces of the adjacent, upper foil b', there are intermediate layers 30 of a material that is a poor conductor of heat. As a result, the aforementioned two foils are largely thermally decoupled from one another. It is understood that if the foils or intermediate foils have a corrugated shape, for instance as in FIG. 5, such intermediate layers may be provided, which in that case then are elongated and strip-like, while in FIG. 13 they are constructed in the form of round disks.

Figure 14:
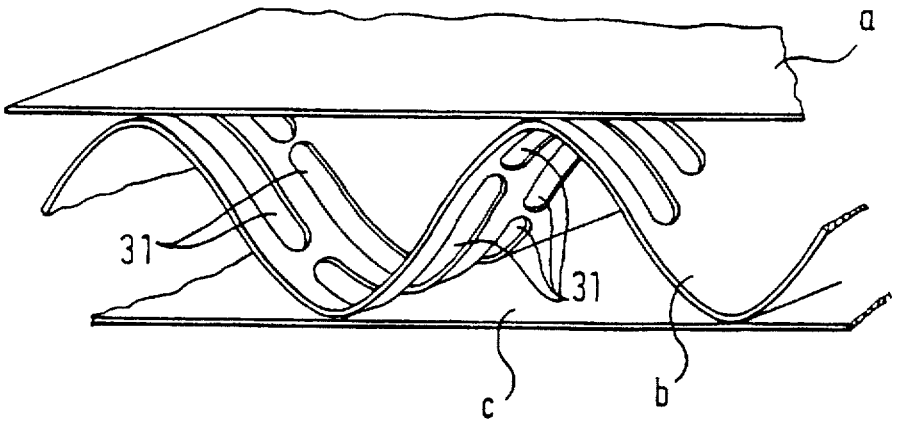
FIG. 14 is a fragmentary, perspective view of a substantially corrugated or randomly shaped foil being disposed as a spacer element between two cover foils.

In the exemplary embodiment of FIG. 14, a substantially corrugated or randomly shaped foil b is disposed as a spacer element between two cover foils a and c. The foil b is continuously provided with mutually overlapping, elongated holes or free cuts 31, which reduces the mass of this intermediate foil b by approximately 90%. In this simple way, thermal conduction between the cover foils a and c is maximally avoided, and a reduction in weight of the foil layer is also attained.

It is possible within the scope of the invention to vary the number of foils within one foil layer in order to suit the thermal load that originates entirely or in part in the heating home appliance to be insulated. It is also possible to use other materials, such as heat-resistant plastics, instead of aluminum. The use of high-heat-resistant material, such as steel, special steel or the like, for at least the inner cover foil is practical whenever the corresponding foil layer directly covers a heating body, for instance the underheater 12 located on the outside as shown in FIG. 1. The edges or peripheral regions of the foil layers may also be sealed or compressed in air-tight fashion, for instance by welding.

We claim:

1. A heating home appliance, comprising:

an appliance space having at least one heating element;

at least one multi-ply layer of air-tight foils having at least one inner foil and outer foils, said outer foils at least partly surrounding said appliance space, enclosing air chambers, being at least peripherally joined together and otherwise being kept mutually spaced apart from one another by said at least one inner foil;

said at least one inner foil forming a plurality of air-tight air chambers between said at least one inner foil and each of said outer foils; and said at least one inner foil and said outer foils having foil edges being compressed together forming bendable, air-tight peripheral sections including an element for fastening and connecting.

2. The heating home appliance according to claim 1, wherein said at least one foil layer is formed of a homogeneous material.

3. The heating home appliance according to claim 1, wherein said at least one foil layer is formed of a homogeneous aluminum foil material.

4. The heating home appliance according to claim 1, wherein said at least one foil layer is a plurality of foil layers and each of said foil layers being air-tightly insulated and at least partly surrounding said appliance space.

5. The heating home appliance according to claim 4, wherein said foil layers have different numbers of said foils.

6. The heating home appliance according to claim 4, wherein said foil layers are components of a common foil layer strip having air spaces isolated from one another by sealed peripheral sections.

7. The heating home appliance according to claim 4, wherein said at least one foil layer includes immediately adjacent foil layers overlapping at boundary regions.

8. The heating home appliance according to claim 4, wherein said plurality of foil layers includes adjacent foil layers abutting one another directly at an abutting point, and having edges being bent away from said abutting point.

9. The heating home appliance according to claim 1, wherein said individual foils of said at least one foil layer have foil embossed locations forming small-area spacer elements keeping said foils spaced apart from one another.

10. The heating home appliance according to claim 9, wherein said at least one foil layer includes at least two outer cover foils and at least one foil being disposed between said outer cover foils and having said embossed locations forming said spacer elements.

11. The heating home appliance according to claim 10, wherein said at least one foil disposed between said outer cover foils is at least two foils having said embossed locations being randomly shaped and crosswise to one another.

12. The heating home appliance according to claim 10, wherein said at least one foil disposed between said outer cover foils is a plurality of inner foils having substantially cup-shaped spacer elements being directed toward one another.

13. The heating home appliance according to claim 12, wherein said spacer elements support one another in honeycomb-like fashion.

14. The heating home appliance according to claim 12, wherein said at least one foil layer is disposed in a given plane, said spacer elements have support surfaces being parallel to said given plane, said support surfaces have foil indentations formed therein, and said at least one foil layer includes at least one adjacent foil having small-area support surfaces being form-lockingly retained in said indentations.

15. The heating home appliance according to claim 14, wherein said foil indentations are circular.

16. The heating home appliance according to claim 10, wherein at least one of said cover foils has protuberances and indentations formed therein by profiling a surface.

17. The heating home appliance according to claim 6, wherein at least one of said edges and said peripheral sections of said foils are interlocked with one another.

18. The heating home appliance according to claim 17, wherein said deep-drawn locations are crimped.

19. The heating home appliance according to claim 17, wherein at least one of said edges and peripheral sections have a plurality of interlocking locations.

20. The heating home appliance according to claim 19, wherein said interlocking locations overlap one another.

21. The heating home appliance according to claim 6, wherein at least one of said edges and peripheral sections of said foils are welded together.

22. The heating home appliance according to claim 10, wherein at least one of said cover foils is formed of a high-heat-resistant material.

23. The heating home appliance according to claim 22, wherein said high-heat-resistant material is selected from the group consisting of sheet steel and special sheet steel.

24. The heating home appliance according to claim 6, including a housing forming said appliance space and having regions being under heavy thermal strain or needing to be thermally relieved, at least one of said edges and peripheral sections of said at least one foil layer being thermally closely coupled to said regions of said housing.

25. The heating home appliance according to claim 24, wherein said housing has a loading flange being peripherally coupled.

26. A household oven, comprising:

an oven box having an appliance space with at least one heating element;

at least one multi-ply layer of air-tight foils having at least one inner foil and outer foils, said outer foils at least partly surrounding said appliance space, enclosing air chambers, being at least peripherally joined together and otherwise being kept mutually spaced apart from one another by said at least one inner foil;

said at least one inner foil forming a plurality of air-tight air chambers between said at least one inner foil and each of said outer foils; and said at least one inner foil and said outer foils having foil edges being compressed together forming bendable, air-tight peripheral sections including an element for fastening and connecting.

* * * * *